US011052686B2

(12) United States Patent
Hayashi

(10) Patent No.: US 11,052,686 B2
(45) Date of Patent: Jul. 6, 2021

(54) IMAGE FORMING APPARATUS

(71) Applicant: Tomoaki Hayashi, Tokyo (JP)

(72) Inventor: Tomoaki Hayashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/819,541

(22) Filed: Mar. 16, 2020

(65) Prior Publication Data

US 2020/0298596 A1 Sep. 24, 2020

(30) Foreign Application Priority Data

Mar. 19, 2019 (JP) ..... JP2019051520

(51) Int. Cl.
*B41J 15/16* (2006.01)
*B41J 11/00* (2006.01)

(52) U.S. Cl.
CPC ..... *B41J 15/16* (2013.01); *B41J 11/008* (2013.01); *B41J 11/0095* (2013.01)

(58) Field of Classification Search
CPC ..... B41J 15/16; B41J 11/0095; B41J 11/008
See application file for complete search history.

(56) References Cited

U.S. PATENT DOCUMENTS

| | | | | |
|---|---|---|---|---|
| 2014/0044460 | A1* | 2/2014 | Kudo | G03G 15/5054 399/301 |
| 2017/0165961 | A1 | 6/2017 | Hayashi et al. | |
| 2018/0272694 | A1* | 9/2018 | Gohda | B41J 11/42 |
| 2018/0272758 | A1* | 9/2018 | Hori | B41J 11/0095 |

FOREIGN PATENT DOCUMENTS

| | | |
|---|---|---|
| JP | 2012-035574 | 2/2012 |
| JP | 2012-056099 | 3/2012 |
| JP | 2014-151988 | 8/2014 |
| JP | 2016-087891 | 5/2016 |
| JP | 2017-159969 | 9/2017 |
| JP | 2017-165094 | 9/2017 |
| JP | 2017-170816 | 9/2017 |
| JP | 2018-065681 | 4/2018 |
| JP | 2018-083406 | 5/2018 |
| JP | 2018-154077 | 10/2018 |

* cited by examiner

*Primary Examiner* — Henok D Legesse

(74) *Attorney, Agent, or Firm* — Oblon, McClelland, Maier & Neustadt, L.L.P.

(57) ABSTRACT

An image forming apparatus is configured to discharge droplets onto a web to form an image. The image forming apparatus includes a conveyor, a web position detector, and control circuitry. The conveyor is configured to convey the web while applying a tension to the web. The web position detector is configured to detect a position of the web during conveyance. The control circuitry is configured to adjust landing positions of the droplets onto the web in a main scanning direction and a sub-scanning direction in accordance with the position of the web detected by the web position detector and control the tension applied to the web by the conveyor. The web position detector is configured to detect the position of the web in a cycle that is at least twice a tension control cycle in which the control circuitry controls a magnitude of the tension.

3 Claims, 5 Drawing Sheets

IMAGE FORMING APPARATUS

CROSS-REFERENCE TO RELATED APPLICATION

This patent application is based on and claims priority pursuant to 35 U.S.C. § 119(a) to Japanese Patent Application No. 2019-051520, filed on Mar. 19, 2019, in the Japan Patent Office, the entire disclosure of which is hereby incorporated by reference herein.

BACKGROUND

Technical Field

The present disclosure relates to an image forming apparatus.

Related Art

An inkjet printer is known as an image forming apparatus that discharges liquid ink onto a continuous sheet-like recording medium (a web), to form an image on the recording medium. An inkjet printer includes a structure that conveys a web that is a sheet-like recording medium wound in a roll while applying tension to the web, and improves the liquid ink landing accuracy.

When the tension being applied to the web fluctuates due to a load, the position of the web (the web position) that is the discharge destination of the liquid ink deviates. This lowers the quality of the image to be formed. To prevent this, it is necessary to reduce the influence of load fluctuation of the tension being applied to the web on the accuracy of the landing position of the liquid ink. Therefore, techniques using an encoder signal or a powder brake have been disclosed to improve the accuracy of control on the tension to be applied to a web.

SUMMARY

In an aspect of the present disclosure, there is provided an image forming apparatus configured to discharge droplets onto a web to form an image. The image forming apparatus includes a conveyor, a web position detector, and control circuitry. The conveyor is configured to convey the web while applying a tension to the web. The web position detector is configured to detect a position of the web during conveyance. The control circuitry is configured to adjust landing positions of the droplets onto the web in a main scanning direction and a sub-scanning direction in accordance with the position of the web detected by the web position detector and control the tension applied to the web by the conveyor. The web position detector is configured to detect the position of the web in a cycle that is at least twice a tension control cycle in which the control circuitry controls a magnitude of the tension.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
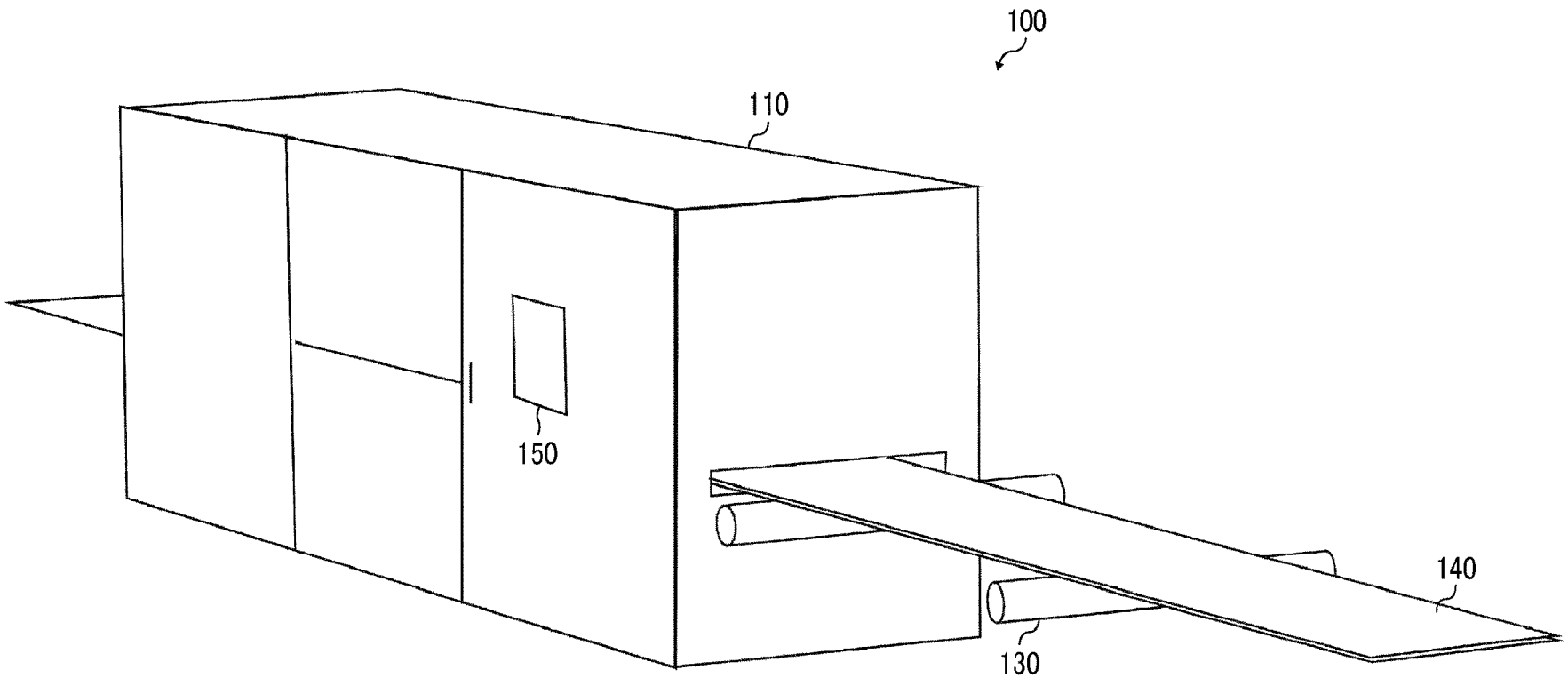
FIG. 1 is a configuration diagram illustrating a system including an image forming apparatus according to an embodiment of the present invention.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

For a web as a medium, the degree of expansion and contraction (readiness to expansion and contraction, or the expansion-and-contraction rate) of the medium due to tension varies depending on the type of the web. Therefore, even if only the tension control accuracy is controlled to cope with tension load fluctuation, there is a limit to prevention of image quality degradation.

In particular, a web during conveyance expands and contracts in both the main scanning direction and the sub-scanning direction. Therefore, a deviation of the landing position of the liquid ink also occurs in both the main scanning direction and the sub-scanning direction. Furthermore, the cycle of deviation occurrence in a web that is subjected to tension and is being conveyed varies between the main scanning direction and the sub-scanning direction. Therefore, these facts need to be taken into consideration when control is performed so that the accuracy of the landing position of the liquid ink is not affected by application of tension.

Overview of an Image Forming Apparatus

An image forming apparatus according to an embodiment of the present disclosure is described, with reference to the accompanying drawings. FIG. 1 is an overall perspective view illustrating an overview of a printing system 100 according to the present embodiment. The printing system 100 is an apparatus including an inkjet printer 110 that forms an image on a web 140 by applying liquid ink to the web 140 that is a continuous sheet-like recording medium (paper, for example). Hereinafter, a position at which the discharged droplets adhere to the web 140 will be referred to as a "landing position".

As illustrated in FIG. 1, the printing system 100 includes one or a plurality of rollers 130. The web 140 is conveyed by the rollers 130. The rollers 130 also adjust the conveyance position for the web 140 being conveyed. The rollers 130 further adjust the magnitude of the tension to be applied to the web 140 being conveyed. The rollers 130 constitute a tension controller.

The printing system 100 also includes an operation panel 150 that functions as a user interface for inputting information indicating the type and the expansion-and-contraction characteristics of the web 140. The operation panel 150 serves as an input device for inputting information to be referred to when a discharge controller 20 (described later) sets a cycle of web position detection to be performed by the sensors 121.

It should be noted that the term "ink" in this specification and the claims is used for a suitable marking fluid (such as a water-soluble ink or an oil paint). The inkjet printer 110 is an ink-jet printer that applies color inks such as cyan (C), magenta (M), yellow (Y), and black (K) inks.

Figure 2:
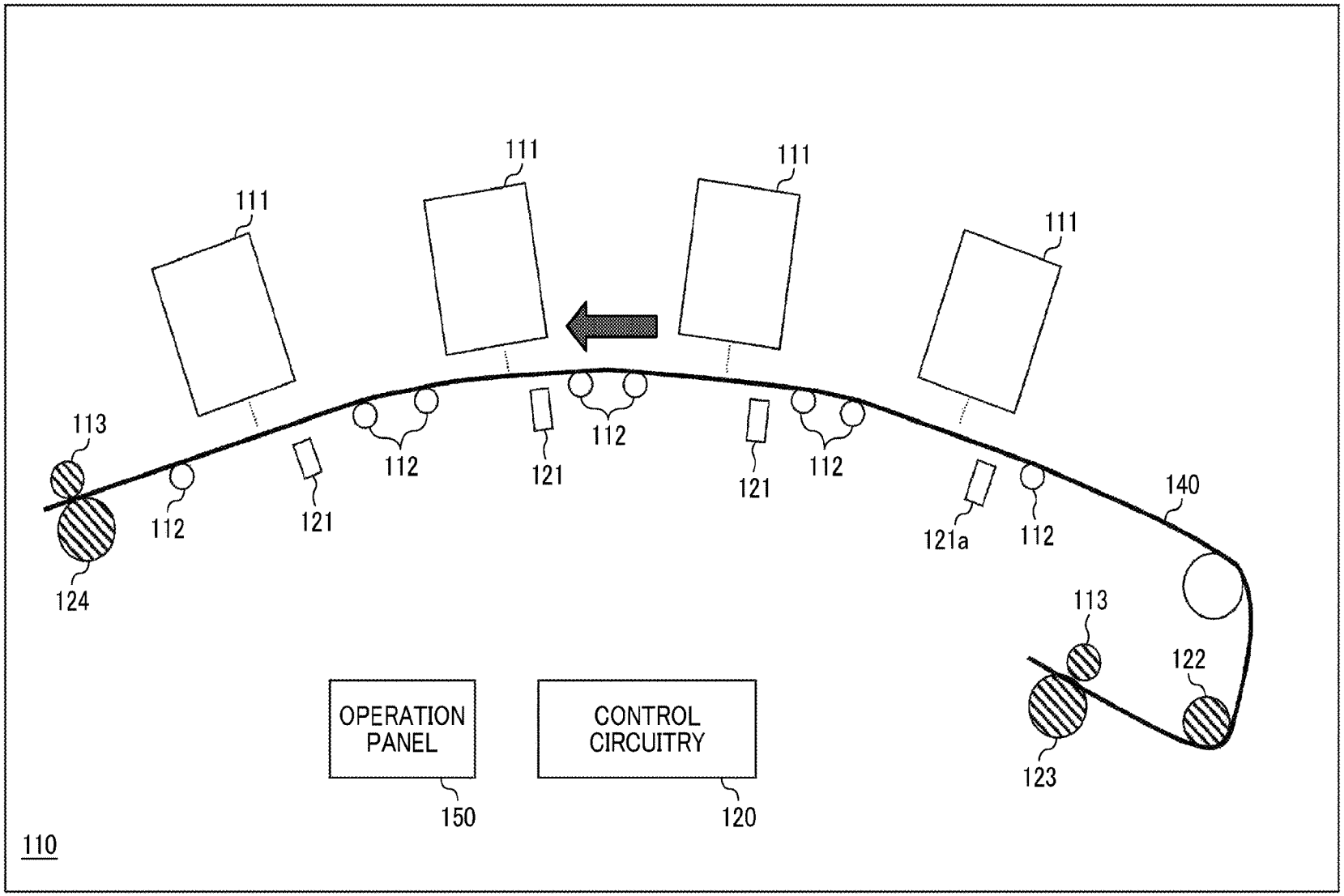
FIG. 2 is a configuration diagram illustrating an overview of the internal configuration of an inkjet printer as an image forming apparatus according to an embodiment of the present invention.

Configuration of the Inkjet Printer Next, the configuration of the inkjet printer 110 according to the present embodiment is described with reference to FIG. 2. The inkjet printer 110 according to the present embodiment can be operated to form an image on a continuous sheet-like recording medium as a printing medium. In the present embodiment, an object on which image formation is performed is referred to as the "web 140".

The inkjet printer 110 includes a plurality of printer heads 111 corresponding to liquid discharge heads that discharge liquid ink onto the web 140. The respective printer heads 111 are installed in the direction of conveyance of the web 140 (the direction indicated by a thick arrow in FIG. 2), and are designed to discharge liquid inks of different colors.

The web 140 is conveyed directly below the printer heads 111. The web 140 is conveyed by a plurality of conveyance rollers 112 arranged in the direction of conveyance of the web 140. It should be noted that "directly below the printer heads 111" means the spaces between the conveyance rollers 112 arranged between the upstream side and the downstream side of the conveyance direction with respect to the printer heads 111. In other words, in a case where attention is paid to a certain printer head 111, "directly below the printer head 111" means the space between the two conveyance rollers 112 arranged so as to sandwich the printer head 111 in the conveyance direction.

The sensors 121 as a web position detector to detect the position of the web 140 during conveyance are disposed immediately below the printer heads 111. The plurality of sensors 121 is arranged in the direction of conveyance of the web 140, and the respective sensors 121 are located directly below the respective printer heads 111. On the basis of detection results from the plurality of sensors 121, the position of the web 140 being conveyed is detected. On the basis of the detected position of the web 140, a deviation of the conveyance position of the web 140 and the timing of a liquid discharge operation are corrected.

The sensors 121 include a system, a component, or a device of any type capable of detecting the position of the web 140 in a non-contact manner. For example, the sensors 121 may include a detection device of a laser type, a charge coupled device (CCD) camera type, an infrared type, an optical type, or some other suitable type. In the present embodiment, the sensors 121 are sensors that detect a web position in accordance with a speckle pattern of the web. Since various kinds of sensors may be used as the sensors 121 as described above, the sensors 121 may be of a type that detects the position of the web on the basis of a mark created by a printer head 111 located on the upstream side.

To form images on both sides of the web 140, it is necessary to use an inkjet printer 110 for the front side and an inkjet printer 110 for the back side. The timing for each printer head 111 to perform a discharge operation is generated, in accordance with the timing at which the most upstream sensor 121*a* disposed at the most upstream position in the conveyance direction among the sensors 121 arranged directly below the respective printer heads 111 has detected the position of the web 140.

The liquid ink discharge timing generated at this stage is different from the discharge timing generated from an encoder disposed on the conveyance rollers 112, and thus, any deviation in synchronization with the rotation cycle due to eccentricity of the conveyance rollers 112 does not occur. Accordingly, there is no need to make the distance between the printer heads 111 an integral multiple of the circumferential length of the conveyance rollers 112, and the restrictions on the layout can be reduced.

Further, as the sensors 121 directly detect the position of the web 140 (a web position) being conveyed directly below the printer heads 111, the sensors 121 are affected neither by slippage between the web 140 and the conveyance rollers 112, nor by thermal expansion of the conveyance rollers 112. Furthermore, as the sensors 121 are arranged directly below the respective printer heads 111, it is possible to cancel the influence of web position detection caused by expansion and contraction of the web 140 between the printer heads 111. If the printer heads 111 and the sensors 121 have a closer positional relationship at this stage, more accurate correction can be performed.

Control circuitry 120 includes a component for controlling the discharge timing of the printer heads 111 on the basis of information about the web position detected by the sensors 121. For example, the components in the control circuitry 120 include a component that receives a detection result from the sensor 121 located directly below the printer head 111 disposed on the most upstream side in the direction of conveyance of the web 140 in the inkjet printer 110. The timing to discharge the liquid ink at the printer head 111 disposed on the most upstream side is then generated from the time spent to convey a predetermined amount of the web 140 as obtained from the detection result. A component is further provided for controlling the discharge operation of the printer head 111 on the basis of the generated discharge timing.

The control circuitry 120 also includes a component that calculates the cumulative amount of conveyance of the web 140 (a web conveyance amount) at the sensors 121 on the downstream side at the same time as the generation of the timing to discharge the liquid ink at the printer head 111 on the most uppermost side. When the web conveyance amount becomes equal to the distance between the sensors 121, the sensors 121 on the downstream side also measure the time spent to convey a specified amount of the web 140, and the timing to discharge the liquid ink at each printer head 111 is corrected.

As described above, the discharge timing is generated by the component in the control circuitry 120, the liquid discharge operation of each printer head 111 is controlled, so that an image is formed. A processor that executes a command according to a program stored in an associated program memory may be used as control circuitry as custom circuitry, for example. Alternatively, such processors may be combined in a specific manner.

The inkjet printer 110 is also designed to apply a predetermined tension to the web 140 passing the printer heads 111, using an upstream motor 123 and a downstream motor 124 disposed at positions in contact with nip rollers 113.

Operations of the upstream motor 123 and the downstream motor 124 are controlled by a tension controller 11 (described later).

Further, the control circuitry 120 in the inkjet printer 110 performs control so that the above mentioned cycle of web position detection at the sensors 121 (the position detection cycle) becomes twice the cycle of tension control to be performed by the tension controller 11 (the tension control cycle). With the components mounted on the control circuitry 120, the timing to discharge the liquid ink is controlled on the basis of the web position detected in the above position detection cycle.

Method for Controlling Conveyance of the Web

Next, a method for controlling conveyance of the web 140 according to the present embodiment is described in greater detail. For example, the velocity of conveyance by the upstream motor 123 in contact with the nip roller 113 on the upstream side (or the rotational velocity of the upstream motor 123) is set as the reference velocity. The velocity of conveyance by the downstream motor 124 in contact with the nip roller 113 on the downstream side (or the rotational velocity of the downstream motor 124) is controlled so that the tension detected by a tension detection roller 122 becomes equal to a tension that has been set by a tension-value setting unit 12 (described later). The control on the velocity of the downstream motor 124 at this stage is feedback control performed by the tension controller 11 (described later).

Note that the control circuitry 120 has a hardware configuration including a circuit board provided with computing means and storage means, and a computer program to be executed with the hardware configuration. Here, the storage means is a memory or the like. The computing means is a microcomputer, a central processing unit (CPU), a field programmable gate array (FPGA), electronic circuitry, or the like.

Functional Blocks of the Control Circuitry

Figure 3:
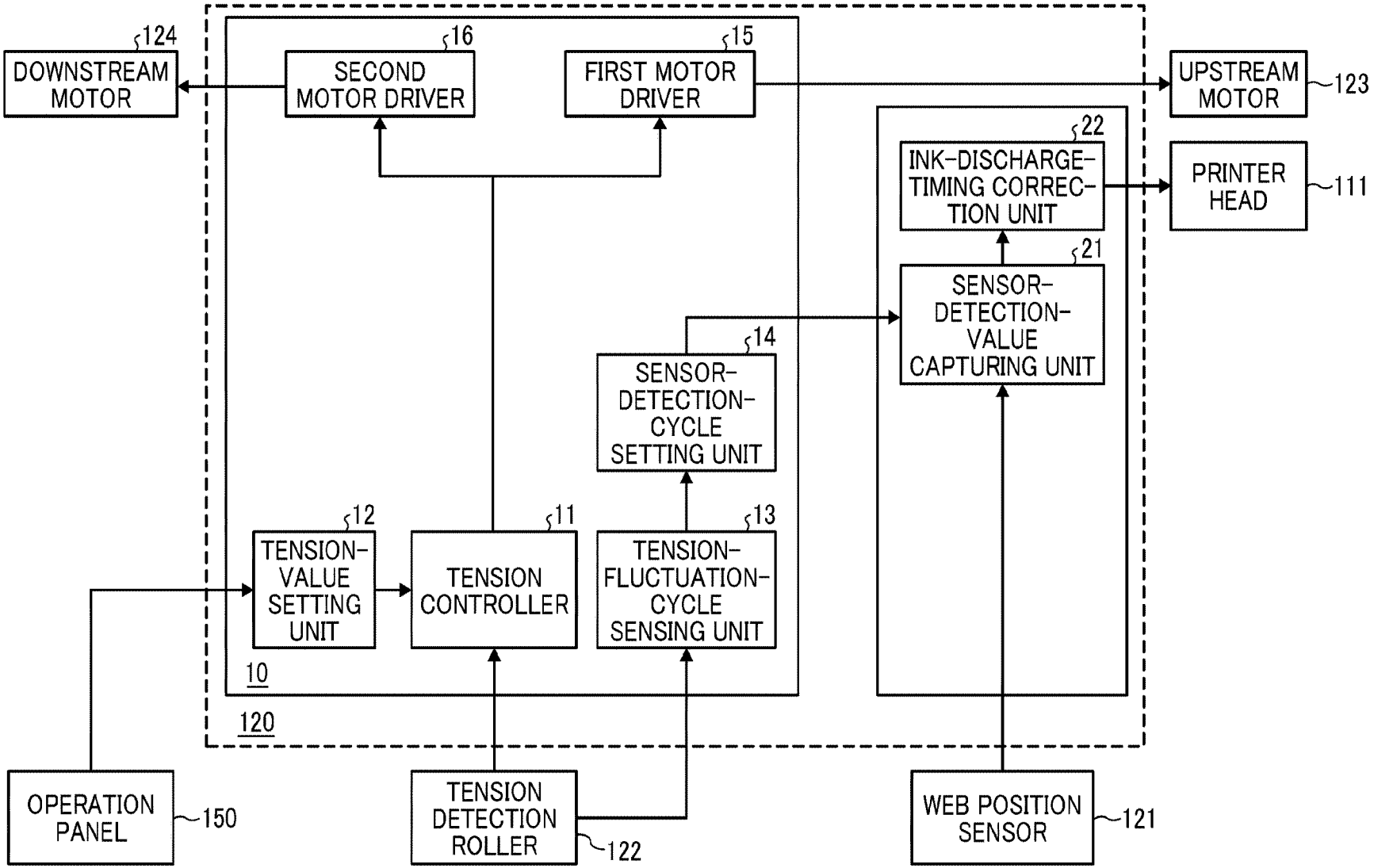
FIG. 3 is a functional block diagram of the inkjet printer.

Next, the functional blocks of the control circuitry 120 in the inkjet printer 110 according to the present embodiment are described, with reference to FIG. 3. As illustrated in FIG. 3, the control circuitry 120 includes a tension fluctuation controller 10 and a discharge controller 20 that is a head controller and controls the liquid discharge timing. The tension fluctuation controller 10 includes a tension controller 11, a tension-value setting unit 12, a tension-fluctuation-cycle sensing unit 13, a sensor-detection-cycle setting unit 14, a first motor driver 15, and a second motor driver 16. The discharge controller 20 includes a sensor-detection-value capturing unit 21 and an ink-discharge-timing correction unit 22.

The tension controller 11 performs velocity control on the first motor driver 15 and the second motor driver 16, to control the tension to be applied to the web 140, on the basis of a detection result supplied from the tension detection roller 122.

The tension-value setting unit 12 notifies the tension controller 11 of the tension value that has been set via the user interface of the operation panel 150 or the like, and sets the tension to be applied to the web 140. The tension-value setting unit 12 also selects an optimum tension on the basis the type of the web 140 that has been set via the user interface of the operation panel 150, and sets the tension value in the tension controller 11. The tension-value setting unit 12 and the operation panel 150 constitute a web type setting unit.

The tension-fluctuation-cycle sensing unit 13 detects the tension fluctuation cycle detected by the tension detection roller 122, and notifies the sensor-detection-cycle setting unit 14 of the detected tension fluctuation cycle.

The sensor-detection-cycle setting unit 14 determines the web position detection cycle of the sensor 121, and notifies the sensor-detection-value capturing unit 21 of the determined web position detection cycle.

Under the control of the tension controller 11, the first motor driver 15 controls the velocity of conveyance of the web 140 by the upstream motor 123.

Under the control of the tension controller 11, the second motor driver 16 controls the velocity of conveyance of the web 140 by the downstream motor 124.

On the basis of a set time supplied from the sensor-detection-cycle setting unit 14, the sensor-detection-value capturing unit 21 captures a result of detection of the web 140 from each sensor 121, and then calculates the web position. The sensor-detection-value capturing unit 21 notifies the ink-discharge-timing correction unit 22 of the calculated web position.

The ink-discharge-timing correction unit 22 notifies the printer heads 111 of an ink discharge signal in which the ink discharge timing has been corrected on the basis of web position information that is sensor detection data.

As described above, with the functional blocks formed by the control circuitry 120, the cycle of web position detection to be performed by the sensors 121 can be controlled on the basis of the tension fluctuation cycle. Accordingly, even if the web 140 expands and contracts when tension is applied to the web 140, the influence of the fluctuation range can be eliminated before the web position is detected. Thus, the accuracy of the landing position of the liquid ink onto the web 140 can be further increased.

Flow of Control to be Performed by the Control Circuitry

Figure 4:
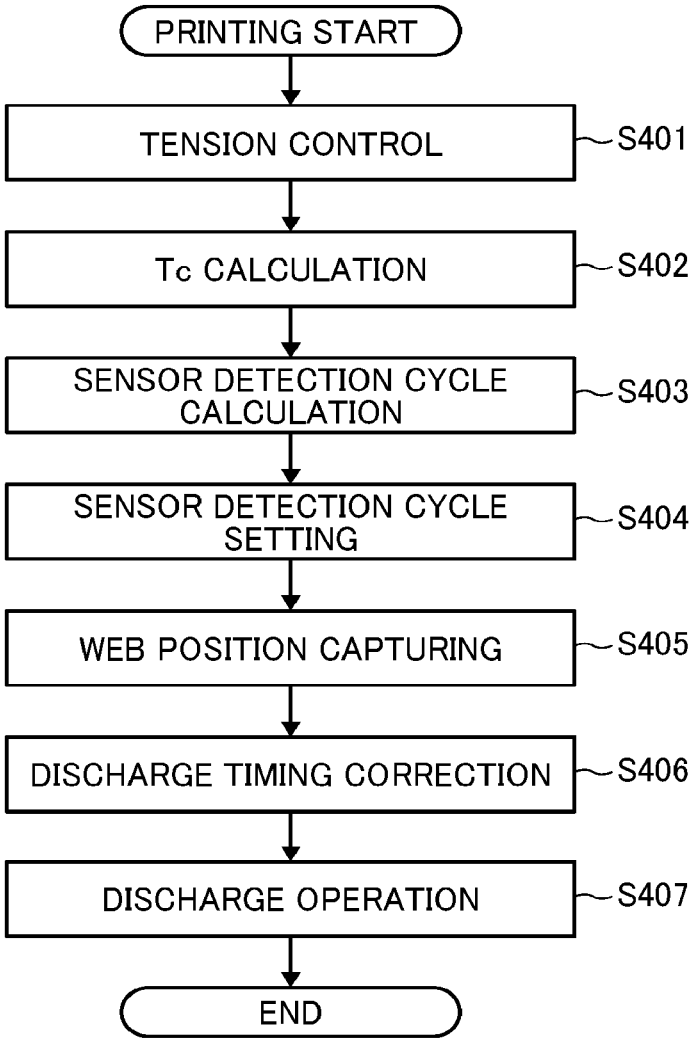
FIG. 4 is a flowchart illustrating the flow of a discharge timing correction process to be performed by the inkjet printer.

Next, the flow of ink discharge operation control based on tension control in the control circuitry 120 according to the present embodiment is described, with reference to the flowchart in FIG. 4.

First, when the inkjet printer 110 starts operating, and conveyance of the web 140 is started, the tension controller 11 controls the upstream motor 123 and the downstream motor 124 in constant cycles (S401). As a result, a controlled tension is applied to the web 140 being conveyed.

With a tension being applied to the web 140 by the tension controller 11, the tension-fluctuation-cycle sensing unit 13 acquires, from the tension detection roller 122, fluctuation peaks of the tension being applied to the web 140, and calculates a tension fluctuation cycle Tc (S402).

On the basis of the tension fluctuation cycle Tc, a cycle of web position capture by the sensors 121 (a cycle of web position detection by the sensors 121) is calculated (S403). In the present embodiment, a sensor detection cycle Sc is twice as long as the tension fluctuation cycle Tc (Sc=tension fluctuation cycle Tc×2).

A cycle that is twice the tension fluctuation cycle Tc is then set as a sensor detection cycle Sc in the sensor-detection-cycle setting unit 14 (S404).

On the basis of the sensor detection cycle Sc set in the sensor-detection-cycle setting unit 14, web position detection by the sensors 121 is conducted, and the result of the detection is captured by the sensor-detection-value capturing unit 21 (S405). The sensor-detection-value capturing unit 21 notifies the ink-discharge-timing correction unit 22 of the web information captured during the sensor detection cycle Sc.

On the basis of the web position information captured during the sensor detection cycle Sc, the ink-discharge-timing correction unit 22 corrects the ink discharge timing, and notifies the printer heads 111 of the corrected ink discharge timing (S406).

As described above, control is performed so that the sensors 121 detect the position of the web 140 in a cycle that is twice the cycle of control on the tension being applied to the web 140. As a result, it is possible to reduce the adverse influence the tension fluctuation caused by expansion and contraction of the web 140 has on the landing position of the liquid ink. In other words, as the timing of the ink discharge operation is corrected on the basis of the web position detected in a cycle that is twice the tension control cycle, it is possible to reduce the adverse influence on the landing position that fluctuates with expansion and contraction of the web 140 due to the tension. As a result, image quality can be improved.

Effects of Tension Control Performed by the Inkjet Printer

Figure 5A:
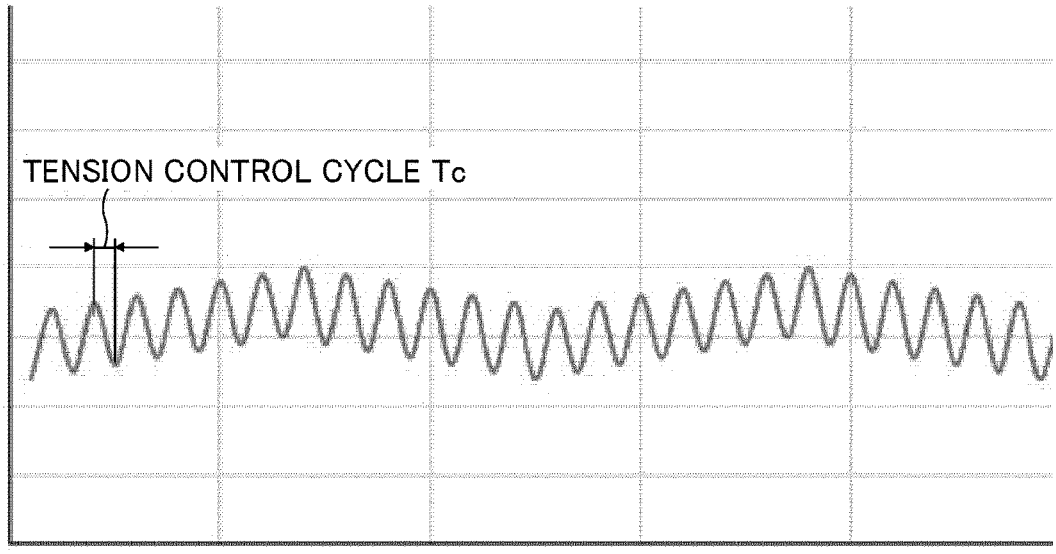
FIGS. 5A and 5B are graphs for explaining the effects of a control method according to an embodiment of the present embodiment.
Figure 5B:
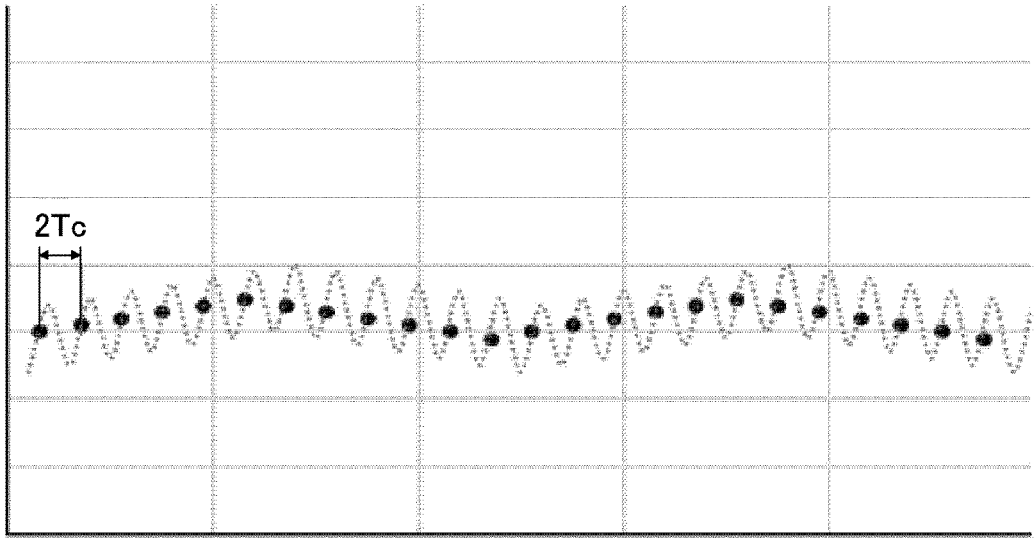

Next, the effects of the present embodiment are described in detail, with reference to FIGS. 5A and 5B. FIG. 5A is a graph for explaining tension control in a conventional example (a comparative example), not the tension control according to the present embodiment.

As illustrated in FIG. 5A, the expansion and contraction of the web 140 to which a tension is being applied repeats in constant cycles. The frequency of this cyclic fluctuation has a form in which a low-frequency wave that is displacements in a direction (sub-scanning direction) orthogonal to the direction of conveyance of the web 140 (main scanning direction) are superimposed on a high-frequency wave that is displacements in the direction of conveyance of the web 140.

In the comparative example, tension control is performed through feedback control, as in the present embodiment. However, in the case of a web 140 having high spring characteristics (a web 140 that easily expands and contracts), if the tension is to be kept constant, overshoot occurs when the tension is increased. When the tension is reduced after overshoot is detected, undershoot occurs instead. In the tension control of the comparative example, control is performed to keep the tension constant while the above control is repeated. Therefore, in the comparative example, the web 140 expands and contracts on the order of micrometers, and the expansion and contraction adversely affects the landing position of the liquid ink. The frequency of the expansion and contraction corresponds to the high-frequency wave illustrated in FIG. 5A, and the cycle of the high-frequency wave is a cycle that is at least twice the tension control cycle.

If landing position correction related to the ink discharge operation is performed on the position of the web 140 that expands and contracts as described above, a deviation of the landing position cannot be eliminated. For example, a deviation in the main scanning direction leads to a deviation in the writing position, and therefore, does not need to be corrected. Accordingly, the position of the web 140 is detected in a cycle that is at least twice the tension control cycle, so that the components excluding the expansion and contraction are detected, and the landing position of the liquid ink can be corrected. Thus, the landing position is appropriately corrected.

FIG. 5B is a graph for explaining the effects to be achieved in a case where web position detection is performed in a cycle that is twice the tension control cycle. As illustrated in FIG. 5B, the web position is detected in a cycle that is twice the tension control cycle. Accordingly, the expansion and contraction of the web 140 can be canceled, and only the meandering of the web 140 can be detected.

The effects of the web position detection method according to the present embodiment described above are greater at a position closer to an edge of the web 140.

In the control circuitry 120 according to the above embodiment, the cycle of detection to be performed by the sensors 121 may be automatically switched depending on the fluctuation range of the detection values obtained by the sensors 121. Alternatively, the cycle detection may be automatically switched in accordance with expansion-and-contraction characteristics information associated with information about the type of the web 140 or the like that has been input by the user via the operation panel 150. Further, the cycle of detection may be manually switched by the user.

In a case where the influence of eccentricity of the rollers or the like is larger than the influence of expansion and contraction cause by tension control, the position detection cycle may be set as a cycle that is not twice the tension control cycle. The setting in this case may be manually performed by the user via the operation panel 150.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus configured to discharge droplets onto a web to form an image, the image forming apparatus comprising:

a conveyor configured to convey the web while applying a tension to the web;

a web position detector configured to detect a position of the web during conveyance; and control circuitry configured to adjust landing positions of the droplets onto the web in a main scanning direction and a sub-scanning direction in accordance with the position of the web detected by the web position detector and control the tension applied to the web by the conveyor, the web position detector configured to detect the position of the web in a cycle that is at least twice a tension control cycle in which the control circuitry controls a magnitude of the tension.

2. The image forming apparatus according to claim 1, further comprising a web expansion-and-contraction amount sensor configured to detect an amount of expansion and contraction of the web, wherein, when a maximum value of the amount of expansion and contraction of the web is larger than a predetermined threshold, the web position detector detects the position of the web in the cycle that is at least twice the tension control cycle, and when the maximum value of the amount of expansion and contraction of the web is not larger than the predetermined threshold, the web position detector detects the position of the web in a cycle that is shorter than twice the tension control cycle.

3. The image forming apparatus according to claim 1, further comprising an operation panel configured to set a type of the web, wherein, in accordance with the type of the web set with the operation panel, the web position detector switches a cycle of detection of the position of the web to the cycle that is at least twice the tension control cycle.

* * * * *